US006027041A

United States Patent [19]

Evans

[11] Patent Number: 6,027,041

[45] Date of Patent: Feb. 22, 2000

[54] SPRAYER WITH SWIVELING SPRAY HEAD

[75] Inventor: Robert M. Evans, Washington, D.C.

[73] Assignee: Evnx Technologies, Inc., Stafford, Va.

[21] Appl. No.: 07/974,106

[22] Filed: Nov. 10, 1992

[51] Int. Cl.[7] ..... B05B 9/043; B05B 15/08; B67D 5/40; B67D 5/60

[52] U.S. Cl. ..... 239/334; 239/587.4; 222/382; 222/464.4; 222/464.6

[58] Field of Search ..... 222/464, 382, 222/211, 383, 324, 526; 285/160, 166, 184; 239/333, 587.1, 587.2, 587.3, 587.4, 588, 525, 332, 329, 330, 331, 302, 334

[56] References Cited

U.S. PATENT DOCUMENTS

| | | | |
|---|---|---|---|
| 1,695,263 | 12/1928 | Jacques | 285/166 X |
| 1,959,102 | 5/1934 | Hummel | 222/464 X |
| 2,128,494 | 8/1938 | Morrow | 222/324 |
| 2,456,182 | 12/1948 | Goble | 285/166 |
| 2,494,837 | 1/1950 | Simmons | 239/333 |
| 2,518,709 | 8/1950 | Mosby, Jr. | 239/587.4 X |
| 2,569,975 | 10/1951 | Cone | 222/464 X |
| 2,647,796 | 8/1953 | Ziherl | 239/587.4 X |
| 2,776,168 | 1/1957 | Schweda | 285/166 X |
| 3,282,510 | 11/1966 | Schwartz | 239/333 X |
| 3,490,656 | 1/1970 | Taschner | 222/394 |
| 3,547,296 | 12/1970 | Greenberg | 222/464 X |
| 3,667,655 | 6/1972 | Knieriem, Jr. | 222/464 |
| 3,921,912 | 11/1975 | Hayes | 239/242 |
| 4,035,004 | 7/1977 | Hengesbach | 285/166 |
| 4,083,476 | 4/1978 | Schwartz et al. | 239/333 X |
| 4,273,272 | 6/1981 | Blanc | 222/464 |
| 4,767,033 | 8/1988 | Gemperle | 239/333 X |
| 4,830,235 | 5/1989 | Miller | 222/464 |
| 4,940,152 | 7/1990 | Lin | 222/464 X |
| 4,958,754 | 9/1990 | Dennis | 222/383 |
| 5,119,974 | 6/1992 | Mann | 222/376 |
| 5,149,146 | 9/1992 | Simoni | 285/166 |
| 5,195,664 | 3/1993 | Rhea | 222/464 |
| 5,215,227 | 6/1993 | Farner | 222/464 X |

FOREIGN PATENT DOCUMENTS

| | | | |
|---|---|---|---|
| 690456 | 4/1940 | Germany | 239/587.4 |
| 2236368 | 8/1973 | Germany . | |
| 317484 | 12/1988 | Japan | 222/464 |
| 24774 | 11/1914 | United Kingdom | 239/333 |
| 735659 | 8/1955 | United Kingdom | 222/211 |
| 2136057A | 9/1984 | United Kingdom . | |

*Primary Examiner*—Lesley D. Morris
*Attorney, Agent, or Firm*—Klima & Pezzlo, P.C.

[57] ABSTRACT

A spray bottle has a ball swivel joint enabling angular orientation of the spray head with respect to the bottle. Both liquid and air are conducted between the pump and the bottle in separate passageways in the swivel joint, thus enabling use of a conventional pump. These passageways may be spaced apart or substantially concentric. A highly flexible pickup hose has a weight at its distal or pickup end, so that the distal and remains immersed in liquid, even when the spray bottle is inverted. In alternative embodiments, the pickup hose is bendable, rather than highly flexible. Tightening a cap adjusts tension on the swivel joint, thus varying pressure required to adjust spray head angularity or to immobilize the spray head at a desired angularity. The swivel joint may include one or more ball members.

12 Claims, 5 Drawing Sheets

SPRAYER WITH SWIVELING SPRAY HEAD

BACKGROUND OF THE INVENTION

1. Field of the Invention

The present invention relates to a spray bottle having a spray head which swivels with respect to the bottle, and a flexible, weighted pickup enabling inverted operation of the spray bottle.

2. Description of the Prior Art

Attempts to provide a spray dispenser having selectively variable nozzle angle are known, as exemplified by U.S. Pat. Nos. 3,921,912, issued to Jerry R. Hayes on Nov. 25, 1975 and 4,035,004, issued to Robert W. Hengesbach on Jul. 12, 1977, and West German Pat. Application No. 2,236,368, published on Feb. 8, 1973. The Hayes patent discloses a nozzle attached to a lawn sprinkler by a ball type swivel joint through which a liquid flows. The sprinkler does not provide pump means, relying on water pressure. Also, the sprinkler is intended for connection to a hose or other pressurized source of water, and no receptacle is provided. The patent to Hengesbach and the German reference disclose elongated nozzle structures used in association with spray apparatus projecting from a pressurized receptacle. Hengesbach provides a multisegment joint connecting a liquid receptacle to a spray gun connected to pressurized air. The multisegment joint includes a plurality of ball joints arranged in series, a flexible tube conducting liquid from ball to ball. The advantage afforded by this invention is to enable variable orientation of the spray gun while maintaining the receptacle in an upright orientation.

The German reference discloses a receptacle having an elongated discharge tube which, when stowed, is disposed adjacent and parallel to a substantially cylindrical pressurized liquid receptacle. The tube swings upwardly to a deployed orientation normal to its stowed orientation.

Spray apparatus having pickup means within the receptacle capable of collecting liquid regardless of receptacle attitude with respect to upright orientation is seen in the following patents. U.S. Pat. No. 3,490,656, issued on Jan. 20, 1970 to Kenneth A. Taschner and U.K. Pat. Application No. 2,136,057, published on Sep. 12, 1984, both provide flexible pickup tubes having weights attached at the pickup end. As the weight seeks a level below the liquid level, the tube flexes to accommodate each succeeding weight location. U.S. Pat. No. 5,119,974, issued to Frederick J. Mann on Jun. 9, 1992, provides two pickup points, one being operable and the other inoperable given any one receptacle attitude with respect to upright orientation.

U.S. Pat. No. 4,958,754, issued to Stephen R. Dennis on Sep. 25, 1990, disclosed a typical manually operated spray head which ejects pressurized liquid in spray form, and pumps air into a receptacle to maintain atmospheric pressure on liquid remaining in the receptacle.

None of the above inventions and patents, taken either singly or in combination, is seen to describe the instant invention as claimed.

SUMMARY OF THE INVENTION

The present invention provides a spraying apparatus comprising spray head and receptacle, the spray head of which can assume selectively variable angularity with the receptacle, the apparatus further being able to deliver liquid to the spray head at any attitude with respect to upright orientation. A ball type swivel joint has two passages therethrough, one for liquid flowing from the receptacle into the spray head, the other enabling air to pass into the receptacle. Pressure is exerated upon a conventional piston pump located in the spray head, which piston draws liquid into the pump by suction, and pressurizes air flowing into the receptacle.

The swivel joint flexes, enabling angularity of the spray head while preserving necessary communication of the liquid and air passages with their respective connection points in the spray head.

A flexible pickup hose has a weight to insure immersion of the pickup end in liquid held within the receptacle. The pickup hose may be highly flexible along its length, or may be substantially rigid, there being a short, flexible section providing a flex joint.

Accordingly, it is a principal object of the invention to provide a flexible joint between a spray head and its association liquid storage receptacle, enabling selectively variable spray head orientation with respect to the receptacle.

It is another object of the invention to provide a spray apparatus having selectively variable spray head orientation and being operable with a conventional manually operated spray head.

It is a further object of the invention to provide a spray apparatus operable in any attitude with respect to upright orientation.

Still another object of the invention is to provide a spray apparatus having a manually assembled flexible joint.

Yet another object of the invention is to provide a spray apparatus exerting selectively variable pressure on a flexible joint, whereby force required to flex the joint is varied as desired by a user.

Yet a further object of the invention is to provide a ball type flexible joint enabling simultaneous and segregated flow of gas and liquid through the swivel joint.

A still further object of the invention is to provide a spray apparatus having liquid and air passages provided by, respectively, a bore in a swivel joint, and a pickup hose arranged to pass through the bore, whereby the passages are enabled while requiring but one bore through the joint.

An additional object of the invention is to provide a spray apparatus pickup having a pickup orifice which remains submerged in liquid contained in the spray apparatus regardless of attitude of the same with respect to upright orientation.

A still further object of the invention is to provide a pickup hose for a spray apparatus which pickup hose has a flexible section, yet is substantially made from rigid tube.

It is an object of the invention to provide improved elements and arrangements thereof in an apparatus for the purpose described which is inexpensive, dependable and fully effective in accomplishing its intended purposes.

These and other objects of the present invention will become readily apparatus upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
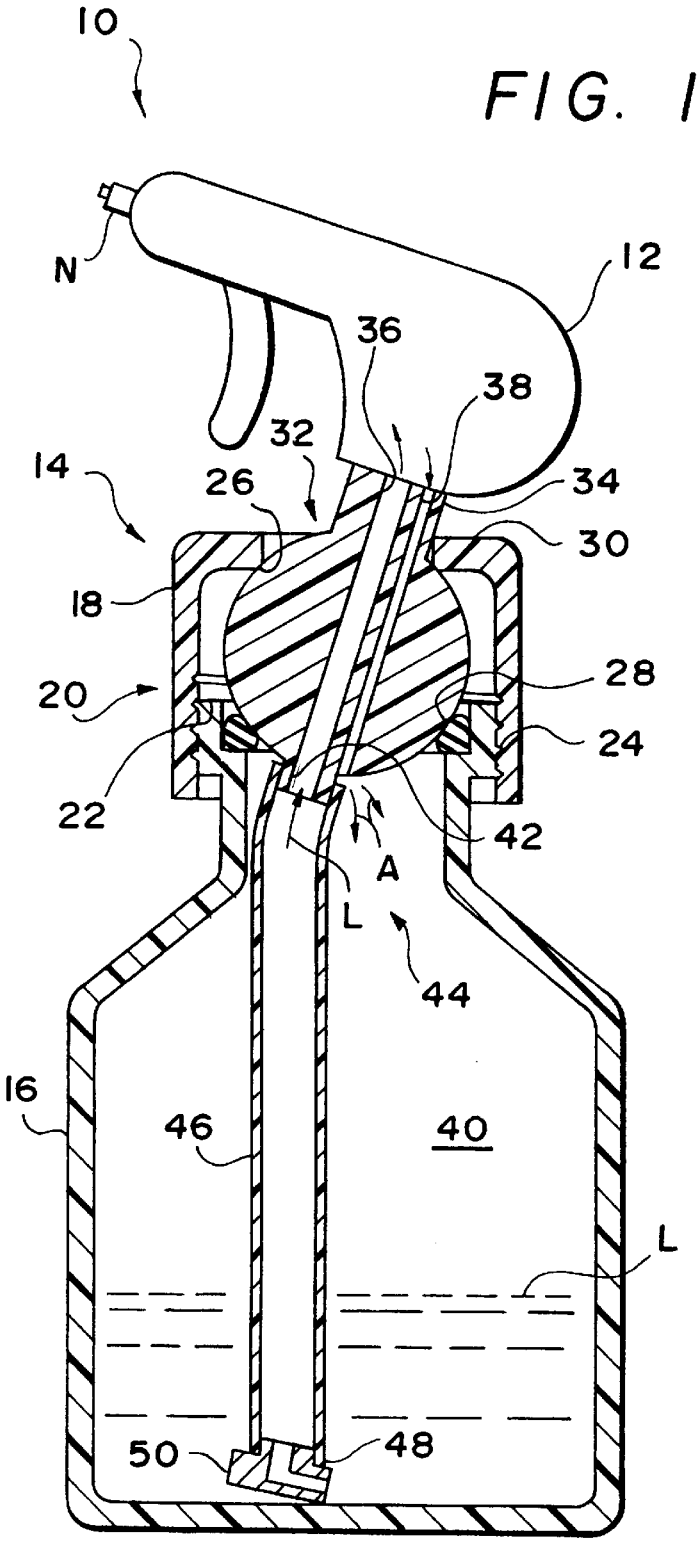
FIG. 1 is a side elevational view, substantially in cross section, of a preferred embodiment of the invention.

The present invention is seen in FIG. 1 to comprise a spray apparatus 10 having a spray head 12, a ball type swivel joint 14 depending from the spray head 12, and a receptacle 16. A cap 18 partially surrounds the swivel joint 14, pinning it against a seat 20 formed in the receptacle 16, which arrangement also secures spray head 12 to receptacle 16. The cap 18 has threads 22 engaging corresponding threads 24 formed on the receptacle 16, and may be adjustably tightened by a user to provide a desired degree of tension on the swivel joint 14.

The cap 18 has a shoulder 26 which bears on the swivel joint 14, forcing it against the seat 20. An O-ring 28 seals the receptacle 16 and modifies properties of the frictional fit of the swivel joint 14 to its seat 20. A user can tighten or loosen the cap 18 to very hand pressure required to adjust angularity of the spray head 12, or to immobilize the spray head 12 in a desired position.

The spray head 12 swivels or pivots about the center of the swivel joint 14, limited only by a top wall 30 of the cap 18 defining an opening 32 therein, against which wall 30 a stem 34 of swivel joint 14 abuts, thus defining a limit of spray head angularity. Connection of stem 34 to spray head 12 is performed within spray head 12 in a manner well known in the art, and need not to be shown or described herein. As seen by comparing FIG. 1 to FIG. 2, spray head 12 varied angularity of orientation with respect to the receptacle 16.

Referring again to FIG. 1, the swivel joint 14 is seen to have first and second passages 36, 38 constantly communicating between the spray head 12 and a liquid storage chamber 40 formed in the receptacle 16. The spray head 12 is of conventional type, employing a piston type pump (not shown) to draw liquid L into the pump, to pressurize and expel liquid L through a nozzle N, and similarly to force air, indicated generally by arrows A, into the chamber 40. This air serves to prevent vacuum from building up in the chamber 40, which would defeat pump operation, and further exerts pressure urging liquid L to flow up to the pump. Liquid L flows from the liquid storage chamber 40 to the pump in the spray head 12 in the first passage 36, this direction being indicated by arrows also designated L, and air flows from the pump into the chamber 40 in the second passage 38.

Swivel joint 14 terminates in a tube 42 extending first passage 36 over which is slipped a proximal end 44 of a hose 46. Hose 46 is preferably made from silicone, which is a highly flexible material resisting attack from or deterioration in response to many strong chemicals, including solvents, herbicides and pesticides, adhesives, architectural coatings and finishings, lubricants, and other liquid products which are applied by spraying. As employed hereinafter, "flexible" will be taken to mean universally flexible, free from kinking, and able to describe 180 degree bends in confines of twice the diameter of the hose.

A distal or pickup end 48 of hose 46 is attached to a weight 50 in the same manner as the proximal end, or by other suitable means. The hose distal end 48 is unobstructed by weight 50 so as to be able to pick up liquid L.

The weight 50 is sufficiently heavy as to urge hose distal end 48 to the lowest point in the storage chamber 40 by means of gravity. Liquid L contained within the storage chamber 40 will also seek the lowest point, thereby maintaining hose distal end 48 immersed therein. Thus, the pump is always supplied with liquid L regardless of attitude of the receptacle 16 with respect to upright orientation. Also, spray apparatus 10 remains operable until liquid L held in storage chamber 40 is substantially depleted.

In an alternative embodiment, hose 46 may be made from a material stiffer than silicone, yet sufficiently flexible to permit hose 46 to bend, such that distal end 48 seeks the lowest point of receptacle 16, although not being capable of describing a 180 degree bend, as could occur if silicone were employed. An advantage is still realized in that when receptacle 16 is tipped, and as it approaches the horizontal, pickup hose 46 continues to seek a lowest level, and thus, distal end 48 remains immersed in liquid L.

Figure 1A:
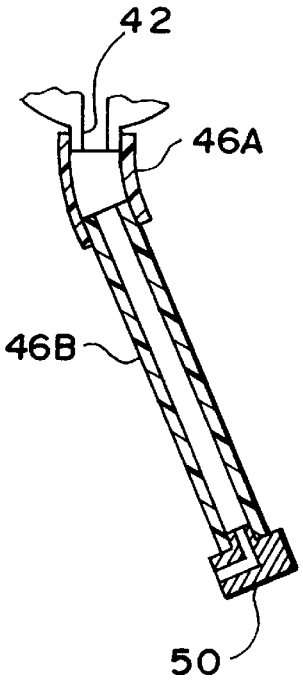
FIG. 1A is a side elevational view, substantially in cross section, of an alternative embodiment pickup hose.

In a still further embodiment, hose 46 may comprise a flexible section 46A and a flexible section 46B, as seen in FIG. 1A. In this embodiment, rigid main section 46A is slipped over tube 42. This embodiment of pickup hose 46 reduces the requirement of selecting a bending material for rigid main section 46B, while minimizing cost accruing from the use of silicone tubing. A further advantage is that weight 50 is more easily secured to more rigid hose section 46A than to a flexible hose.

Figure 2:
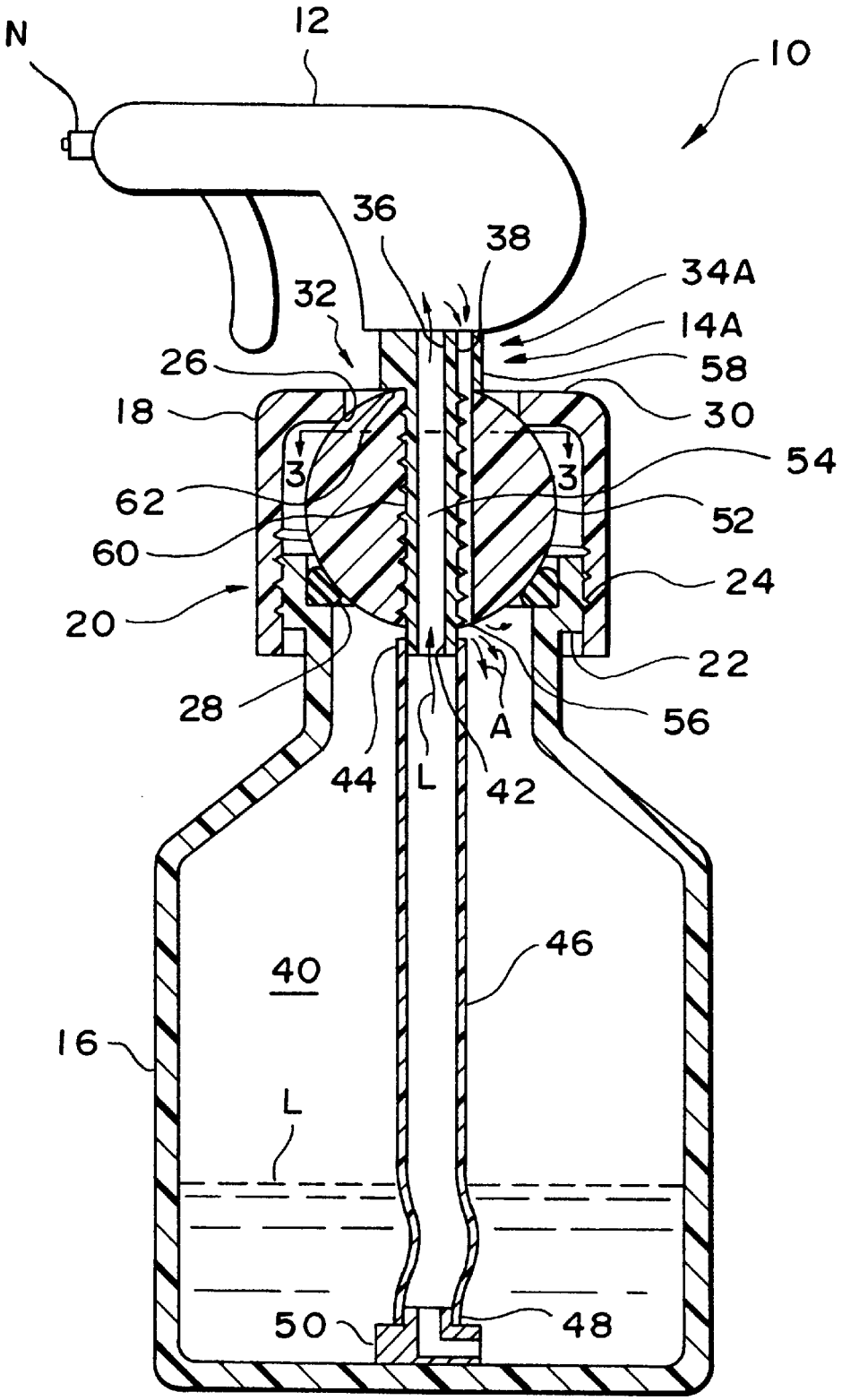
FIG. 2 is a side elevational view, substantially in cross section, of an alternative embodiment of the invention, featuring threaded assembly of the ball joint.

FIG. 2 shows an alternative embodiment spray apparatus 10 wherein a second embodiment swivel joint 14A is formed in two parts. A spherical member 52 includes a throughbore 54 and an associated relief or channel 56 being carved therein and extending therealong in the manner of a keyway (this relief being referred to hereinafter as a keyway 56). The keyway 56 communicates with the throughbore 54 along its entire length.

The stem 34 of the first embodiment discussed herein is modified in the alternative embodiment as follows. The alternative embodiment stem 34A connects to the spray head 12 in similar manner employed in the first embodiment. The portion of the stem 34A connecting to the spray head 12 defines a head section 58. Depending from the head section 58, and having a diameter less than that of the head section 58, is a threaded shank 60.

The swivel joint first passage 36 is formed in the second embodiment stem 34A, extending through both head section 58 and shank 60, thereby passing liquid L up to the pump. The swivel joint second passage 58 is spaced from the first passage, and communicates only to a head lower surface 62 demarcating head section 58 from shank 60.

Figure 3:
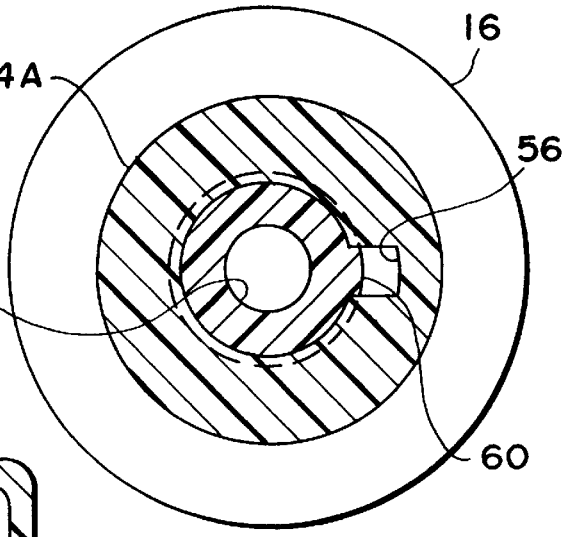
FIG. 3 is a sectional view of the ball joint, taken along line 3—3 of FIG. 2, and drawn to an enlarged scale.

Shank 60 is screwed into the spherical member 52 until abutment ensues between head lower surface 62 and spherical member 52, and the shank 60 extends through and outside spherical member 52. It will be understood that shank 60 terminates at tube 42, again providing for attachment of hose 46. Formation of first passage 36 and second passage 38 by shank 60, throughbore 54, and keyway 56 is seen in FIG. 3.

Upon abutment of head lower surface 62 and spherical member 52, the second passage aligns with keyway 56, thereby forming a continuous flow path for air being ejected from the pump into the liquid storage chamber 40, and complementing first passage 36.

Figure 4:
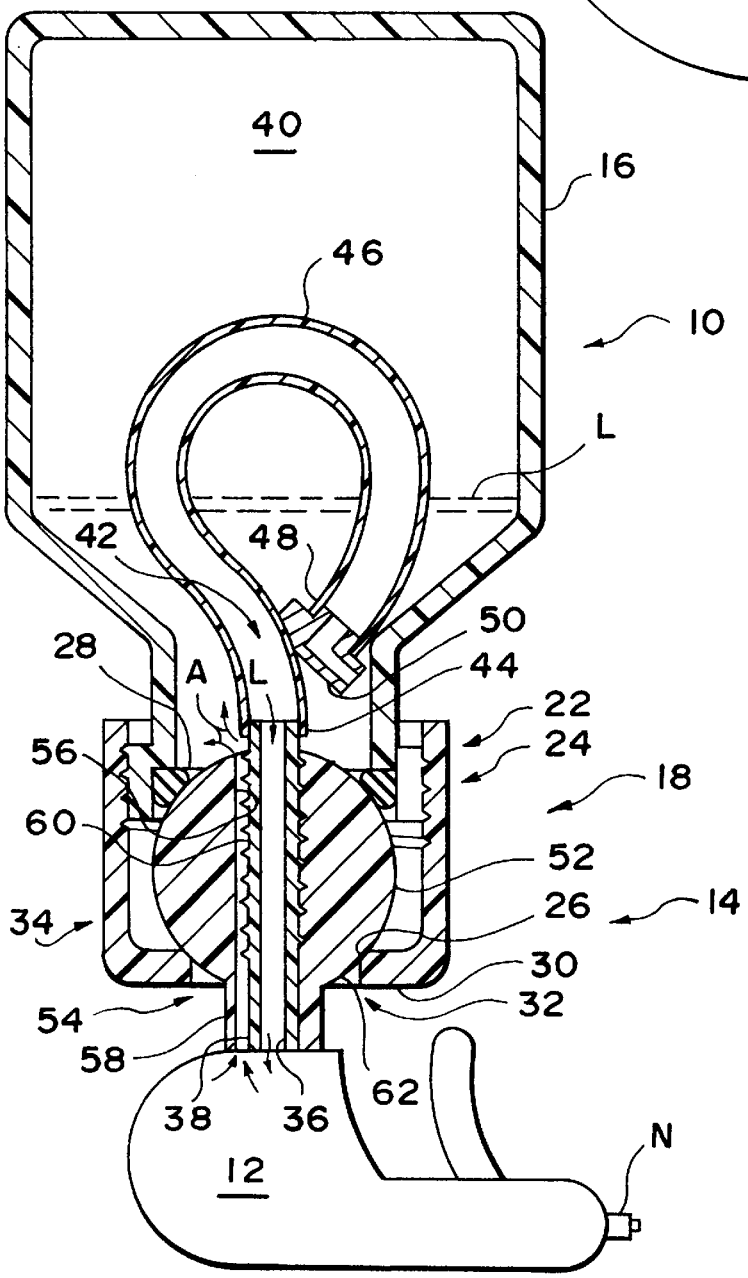
FIG. 4 is a side elevational view, substantially in cross section, of the invention in an inverted position.

Turning now to FIG. 4, the spray apparatus 10 is shown inverted. Liquid L and the pickup hose weight 50 both gravitate toward the swivel joint 14A, the distal end 48 of hose 46 remaining immersed in liquid. Thus, the present invention 10 is usable in any attitude with respect to upright orientation.

Figure 5:
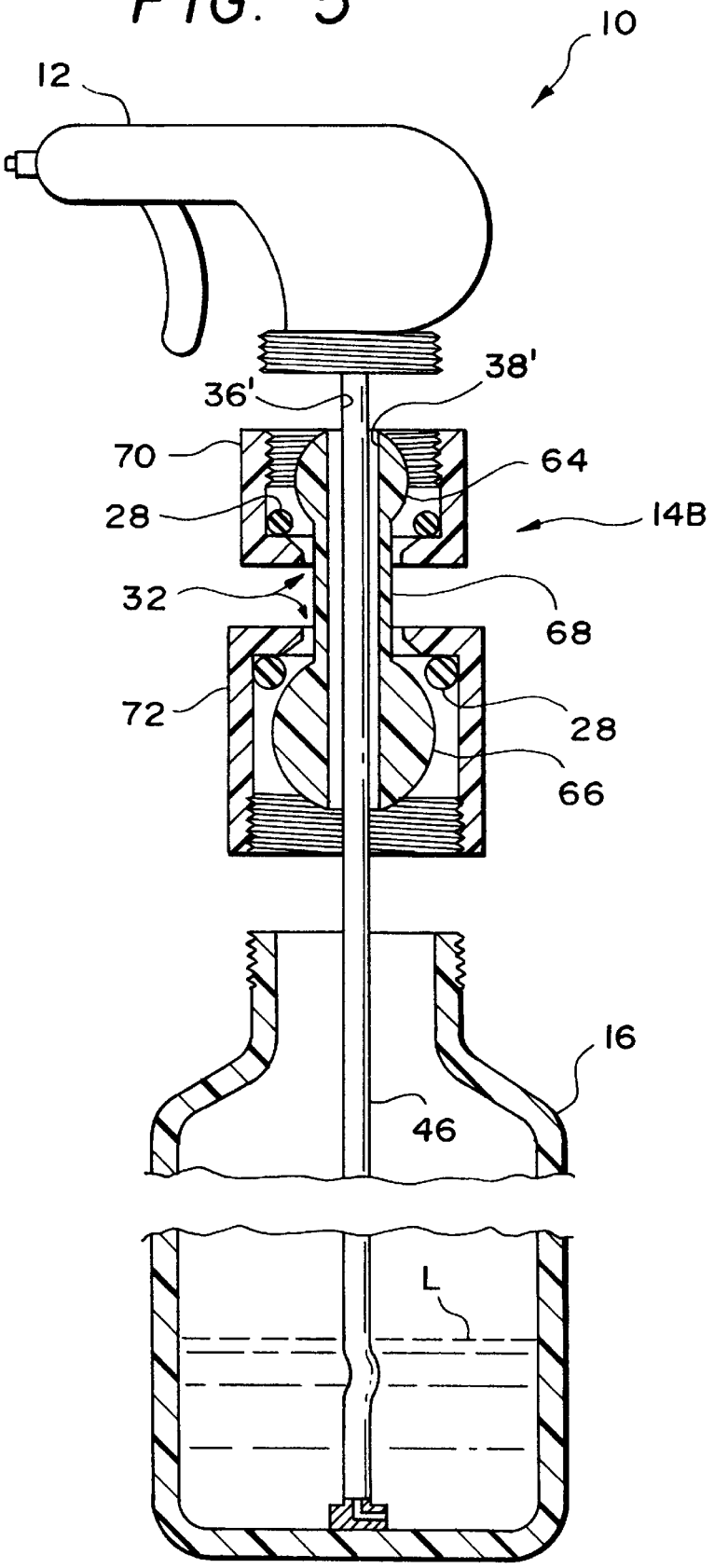
FIG. 5 is a side elevational view, substantially in cross section, of an alternative embodiment of the invention including a dual ball joint.

In an alterative embodiment, as shown in FIG. 5, a swivel joint 14B includes upper and lower spherical members 64, 66 joined by a common neck 68. Spherical member 64 is pivotally retained against spray head 12 by an upper cap 70 threadedly mating to spray head 12, and spherical member 66 is similarly retained by lower cap 72 to the receptacle 16. Upper and lower caps 70, 72 each have an O-ring 28 and opening 32. The plurality of pivot points thus provided enables a greater degree of swivel, or enables each opening 32 to be of correspondingly smaller diameter.

Another feature shown in FIG. 5 is an arrangement wherein passage 38 surrounds passage 38 defining an annulus therebetween. The diameter of passage 38 is made sufficiently great to accommodate hose 46 and still provide space for passage 36. Hose 46 therefore extends entirely through swivel joint 14B, and connects directly to spray head 12.

Figure 6:
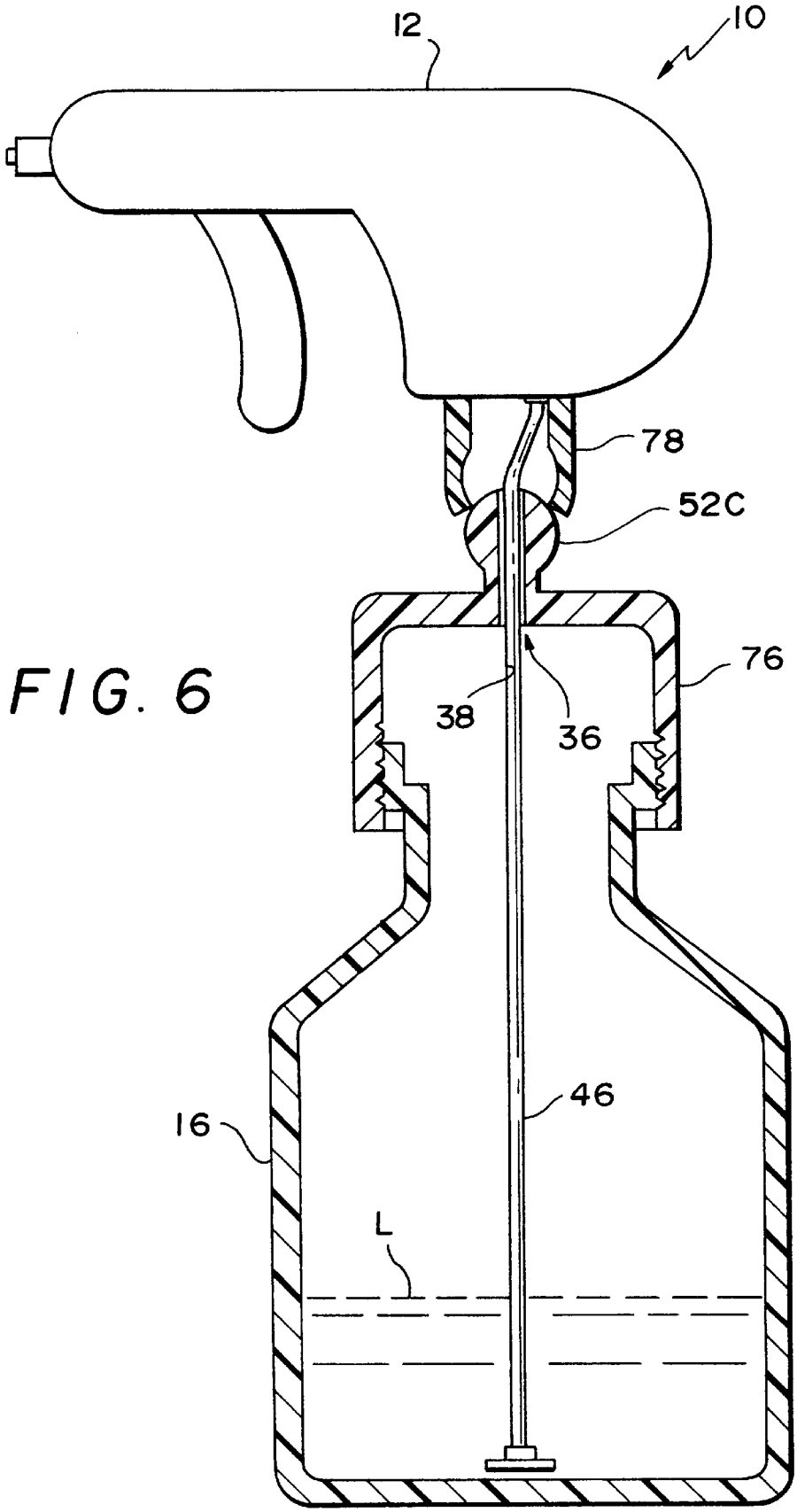
FIG. 6 is a side elevational view, substantially in cross section, of an alternative embodiment of the invention wherein a ball is secured to a receptacle portion of the invention.

In still a further embodiment, shown in FIG. 6, spherical member 52C is formed unitary with a cap 76. A socket 78, depending from the spray head 12, fits over, snaps onto, and pivotally retains spherical member 52C. Since spray head 12 is spaced apart from spherical member 52C in this embodiment, it is advantageous to employ the arrangement wherein hose 46 passes through passage 36, since an offset location of connection of hose 46 to spray head 12 is accommodated by space thus created, enabling hose 46 to flex without being pinched.

Cap 76 attaches securely to the receptacle 16, being threaded thereto. Since caps 18, 70, 72, 76 have threaded connection, ready assembly and disassembly of the spray apparatus 10 is enabled. This facilitates assembly and enables ready servicing, as for refilling receptacle 16, renewing O-ring 28, or for other purposes.

The ability to swivel the spray head 12, thus varying spray head angularity, combined with the ability to operate at any attitude results in a spray apparats 10 very well suited for spraying liquids in tight quarters and awkward or inaccessible locations in those situations favoring the use of standard manually pumping spray heads.

It is to be understood that the present invention is not limited to the embodiments described above, but encompasses any and all embodiments within the scope of the following claims.

I claim:

1. A spray apparatus, comprising:

a receptacle;

a spray head including a nozzle and pump for ejecting liquid in spray form and forcing a gas into said receptacle;

a swivel joint including at least one spherical member, said swivel joint attached to and located between said spray head and said receptacle, said swivel joint including first and second passages, one of said first and second passages conducting liquid from said receptacle into said spray head, and the other of said first and second passages conducting air from said spray head into said receptacle; and a fluid pickup extending into said receptacle, and connecting to one of said first and second passages; and an attachment enabling ready attachment of said spray head to said receptacle.

2. The spray apparatus according to claim 1, wherein said fluid pickup comprises a flexible hose having a proximal end and a distal end, said proximal end being connected to the spray apparatus, and said distal end being attached to a weight, whereby said distal end is held submerged by said weight within liquid contained within said receptacle, regardless of receptacle attitude with respect to an upright orientation.

3. The spray apparatus according to claim 1, wherein said fluid pickup comprises a bending hose having a proximal end and a distal end, said proximal end being connected to said spray apparatus, and said distal end being attached to a weight whereby said distal end inclines in response to gravity when said receptacle is tipped and approaches the horizontal.

4. The apparatus according to claim 1, further comprising a retention cap, said at least one spherical member being captively retained by said cap, said cap being threaded to said receptacle, whereby variable pressure is exerted on said at least one spherical member, and a force required to flex said swivel joint means thus being varied by a user upon tightening said cap.

5. The spray apparatus according to claim 1, wherein said swivel joint is defined by two spherical members joined by a common neck, one of said two spherical members being secured to said spray head, and the other of said two spherical members being secured to said receptacle.

6. The spray apparatus according to claim 1, wherein said swivel joint defines a bore therethrough, said bore having a diameter, said fluid pickup further having a diameter of lesser dimension than said bore diameter, said fluid pickup being disposed within said bore, said bore and said fluid pickup defining an annulus therebetween, whereby liquid is conducted upwardly within said fluid pickup, and air is conducted into said receptacle within said annulus, and whereby said first and second passages are provided by said annulus and said fluid pickup.

7. The spray apparatus according to claim 1, said at least one spherical member having a threaded throughbore having a distal end and a proximal end defined therein, said at least one spherical member further defining a keyway therein, said keyway extending outside said threaded throughbore and also extending from said throughbore proximal end to said throughbore distal end, and a stem comprising a threaded rod having an axis, a head section having a diameter, a top surface defining a stem proximal end, and a bottom surface having a threaded shank depending therefrom, said shank having a diameter of dimension less than said head section diameter, said shank further defining a stem distal end being located on said stem opposite said stem proximal end, said stem defining a first passage extending therethrough and extending from said stem proximal end to said stem distal end, and a second passage extending only through said head section and being located to align with said keyway, said threaded shank having threads corresponding to said threaded throughbore, whereby said threaded shank is screwed into said at least one spherical member, and upon abutment of said head section bottom surface against said at least one spherical member, and upon alignment of said head section second passage with said keyway, two segregated flow paths are established extending between said spray head and said receptacle, and flow of liquid is enabled from said receptacle into said spray head, and of air from said spray head into said receptacle.

8. The spray apparatus according to claim 1, further comprising, in combination, a cap, said at least one spherical member being solidly secured to said cap, the cap and spherical member combination being fixed to said receptacle, and a socket member partially surrounding and pivoting about said at least one spherical member, said socket member being solidly fixed to said spray head, whereby said spray head and said socket member pivot in unison about said at least one.

9. A spray apparatus, comprising:

a receptacle having a liquid storage chamber;

a spray head including a nozzle and pump for ejecting liquid in spray form and forcing a gas into said receptacle, said spray head comprising an attachment for enabling ready attachment of said spray head to said receptacle;

a swivel joint attached to said spray head, said swivel joint including at least one spherical member, said swivel joint attached to and located between said spray head and said receptacle, and further including first and second passages, one of said first and second passages conducting liquid from said receptacle into said spray head, and the other of said first and second passages conducting air from said spray head into said receptacle; and a fluid pickup communicating with said spray head means and extending into said receptacle means.

10. The spray apparatus according to claim 9, said swivel joint means comprising a spherical member having a threaded throughbore having a distal end and a proximal end defined therein, said spherical member further defining a keyway therein, said keyway extending outside threaded throughbore and also extending from said throughbore proximal end to said throughbore distal end, and said stem being a threaded rod having an axis, a head section having a diameter, a top surface defining a stem proximal end, and a bottom surface having a threaded shank depending therefrom, said shank having a diameter of dimension less than said head section diameter and defining a stem distal end being located on said stem opposite said stem proximal end, said threaded shank having threads corresponding to said threaded throughbore, whereby said threaded shank is screwed into said spherical member, and upon abutment of said head section bottom surface against said spherical member, and upon alignment of said head section second passage with said keyway, two segregated flow paths are established extending between said spray head and said liquid storage chamber, and flow of liquid is enabled from said liquid storage chamber into said spray head, and of air from said spray head into said liquid storage chamber.

11. The spray apparatus according to claim 9, said fluid pickup means comprising a flexible hose having a proximal end and a distal end, said proximal end being connected to said swivel joint means, and said distal end being attached to a weight whereby said distal end is constrained to remain submerged within liquid being contained within said receptacle means, regardless of receptacle attitude with respect to an upright orientation.

12. The spray apparatus according to claim 9, further comprising a cap, said swivel joint means being captively retained by said cap to said receptacle means, whereby variable pressure is exerted on said swivel joint means, force required to flex said swivel joint means thus being varied by a user upon tightening said cap.

* * * * *